US006054961A

United States Patent [19]

Gong et al.

[11] Patent Number: 6,054,961

[45] Date of Patent: Apr. 25, 2000

[54] DUAL BAND, GLASS MOUNT ANTENNA AND FLEXIBLE HOUSING THEREFOR

[75] Inventors: Peng Gong, Addison; Francisco X. Gomez, Melrose Park, both of Ill.

[73] Assignee: Andrew Corporation, Addison, Ill.

[21] Appl. No.: 08/929,200

[22] Filed: Sep. 8, 1997

[51] Int. Cl.[7] ..... H01Q 1/32

[52] U.S. Cl. ..... 343/713; 343/795; 343/822; 343/807

[58] Field of Search ..... 343/713, 715, 343/827, 700 MS, 795, 725, 807; 333/26; 455/426; H01Q 1/32

[56] References Cited

U.S. PATENT DOCUMENTS

| | | | |
|---|---|---|---|
| 2,239,724 | 4/1941 | Lindenblad | 250/33 |
| 4,746,925 | 5/1988 | Toriyama | 343/713 |
| 4,766,440 | 8/1988 | Gegan | 343/700 MS |
| 4,775,866 | 10/1988 | Shibata et al. | 343/700 MS |
| 4,825,220 | 4/1989 | Edward et al. | 343/795 |
| 4,860,019 | 8/1989 | Jiang et al. | 343/795 |
| 4,873,532 | 10/1989 | Sakurai et al. | 343/713 |
| 4,916,456 | 4/1990 | Shyu | 343/713 |
| 5,036,335 | 7/1991 | Jairam | 343/767 |
| 5,095,314 | 3/1992 | Shinnai et al. | 343/713 |
| 5,278,575 | 1/1994 | Thomas | 343/795 |
| 5,307,556 | 5/1994 | Kido | 29/600 |
| 5,353,039 | 10/1994 | Tsukada et al. | 343/713 |
| 5,376,943 | 12/1994 | Blunden et al. | 343/795 |
| 5,402,136 | 3/1995 | Goto et al. | 343/729 |
| 5,408,241 | 4/1995 | Shattuck, Jr. et al. | 343/700 MS |
| 5,428,364 | 6/1995 | Lee et al. | 343/767 |
| 5,511,238 | 4/1996 | Bayraktaroglu | 455/81 |
| 5,541,611 | 7/1996 | Peng et al. | 343/767 |
| 5,548,297 | 8/1996 | Arai et al. | 343/700 MS |
| 5,561,435 | 10/1996 | Nalbandian et al. | 343/700 |
| 5,563,616 | 10/1996 | Dempsey et al. | 343/753 |
| 5,604,506 | 2/1997 | Rodal | 343/791 |
| 5,621,420 | 4/1997 | Benson | 343/791 |
| 5,625,365 | 4/1997 | Tom et al. | 343/700 MS |

OTHER PUBLICATIONS

Kai Chang, Handbook of Microwave and Optical Components, vol. 1, pp. 849–860, 1989, New York, NY.

Richard C. Johnson, Antenna Engineering Handbook, pp. 7–16 to 7–18, 1993, New York, NY.

*Primary Examiner*—Don Wong
*Assistant Examiner*—Shi-Chao Chen
*Attorney, Agent, or Firm*—Vedder Price Kaufman & Kammholz

[57] ABSTRACT

The present invention is directed to a dual band, omnidirectional antenna having a symmetrical radiating structure defined by a pair of conductive portions interconnected by a tuning bridge formed on a printed circuit board. An outer housing holds the circuit board in place. An adhesive layer is used to secure the antenna to a dielectric, such as the rear window of an automobile. The antenna housing incudes an outer surface includes a plurality of surface interruptions in the form of ridges and valleys that render the housing flexible so that it may conform to the shape of different mounting surfaces. The tuning bridge of the antenna permits tuning of the resonant frequency bands for the radiating structure to define two separate and distinct, selectable frequency bands.

42 Claims, 3 Drawing Sheets

DUAL BAND, GLASS MOUNT ANTENNA AND FLEXIBLE HOUSING THEREFOR

BACKGROUND OF THE INVENTION

The present invention relates generally to antenna systems for use in wireless communication systems. More particularly, the present invention relates to dual and multi-band antenna systems for use in wireless communication systems.

The expansion of mobile and personal cellular telephone systems has been rapid and widespread during the last few years. originally, cellular telephone systems were designed to provide communications services primarily to vehicles and thus replace mobile radio telecommunication systems. Advancements in technology and production have sufficiently decreased the costs of cellular service to the point at which cellular telephone service has now become affordable to a majority of the general population. Therefore, a "cellular telephone system" no longer strictly refers exclusively to cellular telephones, which originally were physically attached to and made a part of a vehicle. A cellular telephone system now includes portable, personal telephones which may be carried in a pocket or purse and which may be easily used inside or outside a vehicle or building.

Traditionally, wireless communication systems have included antenna systems which transmit and receive radio frequency ("RF") signals within the AMPS bands of frequencies in the United States or the GSM bands of frequencies in Europe. Wireless communication systems which operate in the AMPS or GSM frequency bands generally operate in a low frequency band. In the United States, the AMPS bandwidth used for cellular communication extends from about 824 Mhz to about 894 MHz. In Europe, the GSM bandwidth extends from about 890 MHz to about 960 MHz.

The wireless communications industry has recently broadened the scope of communications services by providing small, inexpensive, hand-held transceivers that transmit and receive voice and/or data communications, notwithstanding the geographic location of the user. This newer communications system operates at a higher frequency band than the AMPS/GSM frequency bands and has generally been referred to as a personal communication network/personal communication system ("PCN/PCS"). The PCN/PCS-type systems are envisioned to be wireless communication systems which should, for all intents and purposes, eliminate the need for separate telephone numbers for the home, office, pager, facsimile or car.

With the recent surge in the use of wireless communication devices, a need has grown to extend the capacity and to improve the communication quality and security of the applicable wireless communication system has also grown. As such, several countries and communication providers have agreed upon international communication standards and set aside a portion of the ultra-high frequency microwave radio spectrum as frequency bands which are dedicated exclusively for PCN/PCS communication systems.

On a worldwide basis, the PCN/PCS frequency band is expected to extend from about 1.5 GHz (1500 MHz) to about 2.4 GHz (2400 MHz). Within that band, individual countries have set aside particular portions of it for their respective PCN/PCS wireless communication systems. For example, Japan has set aside from about 1.49 GHz (1490 MHz) to about 1.521 GHz (1521 MHz), Europe has set aside from about 1.710 GHz (1710 MHz) to about 1.880 GHz (1880 MHz) and the United States has set aside from about 1.850 GHz (1850 MHz) to about 1.990 GHz (1990 MHz) for their PCN/PCS systems.

The bandwidths of the above different frequency bands represent approximately 11%, or only about 200 MHz, of the total possible bandwidth set aside for PCN/PCS-type wireless communication systems. The lowest frequency included within this PCN/PCS bandwidth is almost two times higher than the standard frequency of around 800 MHz at which cellular telephone communication systems operate within the United States. As a general rule, one can consider the conventional wireless communication frequency bands and the intended PCN/PCS frequency bands to be separated by just about 1000 MHz.

While operating within the PCN/PCS frequency bands, wireless communication systems typically employ principles of digital communication that have improved the communication quality and strengthened their security of the PCN/PCS over the conventional cellular telephone systems which utilize the lower frequency bands.

An ever increasing number of regions within the United States now utilize the PCS frequency bands for wireless communications, while in Europe, the use of PCN frequency bands is growing. In most of these regions, wireless telephone units must be able to operate in both the higher and lower bands of frequency (i.e., in both the AMPS and PCS frequency bands in the United States; in both the GSM and PCN frequency bands in Europe) so that a user of such units may selectively choose the frequency band of operation for the unit. Additionally, the units themselves may selectively choose their frequency band of operation so that the chosen band matches the frequency band of the electromagnetic signals received from a wireless telephone unit placing an incoming call to that particular unit.

Under these circumstances, it is desirable to develop antenna systems that are tuned to resonate within both of the above-identified bands of frequency (i.e., the AMPS and PCS bands for United States-based wireless communication systems and the GSM and PCN bands for European-based wireless communication systems). One approach would be to use a dual port antenna system utilizing two radiators with each radiator being tuned to resonate within a different frequency band. Although theoretically feasible, as a practical matter, this type of antenna systems is undesirable because it would be larger than a single radiator system. Furthermore, such an antenna system would require two RF signal feed lines resulting in a system more expensive to manufacture, thereby increasing the ultimate cost to the consuming public.

In light of these disadvantages, there is a present need for a single port, dual band antenna that is tuned to resonate within both bands of frequency in the user's region, i.e., in both the AMPS and PCS frequency bands in the United States and in both the GSM and PCN frequency bands in Europe.

One dual band antenna system generally available in the prior art uses the structure of a monopole antenna modified for dual band operation. Broadband monopole antennas are widely used in the mobile antenna design industry because of their simple embedding characteristics, their solid mechanical features and their inherent advantages over a ground plane environment. However, it is believed that some dual band antenna systems utilizing monopole radiators would be unable to maintain the simple structure of a standard broadband monopole antenna and/or obtain the minimum level of efficiency within both of the resonant bands of frequency necessary for commercially marketable quality of the product. Design modifications that would be necessary to allow those antenna systems to operate have raised the complexity of the systems as well as their cost.

Further, dual band antenna systems utilizing monopole radiators are typically mounted externally on the vehicle so that the monopole radiator is exposed to the external environment, which may lead to a shorter life and less efficient performance due to the environment. Finally, dual band, monopole radiator antenna systems are undesirable because they are not low profile. Accordingly, as a practical matter, dual band, monopole radiator antenna systems are not a feasible solution to the above-identified dilemma.

The second type of prior art dual band antenna systems are antenna systems that utilize two microstrip antennas. These are not typically single port, dual band antennas, but are rather dual port, dual band antenna systems. These systems have a major disadvantage in that they need an additional RF signal feed line. Furthermore, the operation of microstrip antenna dual band antenna systems depends upon the use of a ground plane. If a ground plane is not included or cannot be used in the system, the antenna will not operate.

The standard microstrip antenna configuration comprises two conductive layers of material separated by a passive substrate such as a printed circuit board. One conductive layer serves as the radiator portion of the antenna while the other conductive layer serves as a ground plane. This inherent need for a ground plane by all microstrip antennas makes them less desirable than the ground plane independent antenna of the present invention.

Still, dual band antenna systems that utilize microstrip antennas are classified as directional antennas since the electromagnetic signals are transmitted from and received by the antenna in a single direction, usually from the radiator portion of the antenna away from its associated ground plane.

A third prior art dual band antenna system utilizes a monopole type radiator connected to an external coupling element that is capacitively coupled with an internal coupling element. The internal coupling element is, in turn, connected to the transceiver by an RF signal feed line. These antenna systems may be glass mounted but their use has revealed a considerable number of disadvantages. In particular, such glass mount antennas utilize two modules mounted on respective outside and inside surfaces of a window in order to transmit signals between the opposing modules through the window glass. In these capacitively coupled antenna systems, two metal plates are used in the modules which cooperatively act as a capacitor to transmit RF energy through the intervening dielectric window glass.

These glass mount capacitive coupling-type antenna systems are also disadvantageous because they require a ground plane. Most glass mount surroundings cannot provide an ideal ground plane for the monopole radiator section of the antenna system, thereby degrading its performance. Furthermore, the physical characteristics of the dielectric to which the antenna is mounted, i.e., the window, generally inhibit sufficient capacitive coupling between the two coupling elements in both of the desired frequency bands. As such, loss occurs in the prior art glass mount antennas because they must propagate RF signals through the dielectric material and must further match the impedance of the external monopole type radiator.

Finally, the monopole type radiator used in these coupled dual band antenna systems is also mounted externally on a vehicle so that these systems are susceptible to the previously described disadvantages which result from exposure of portions of an antenna system to the outside environment.

In light of the aforementioned shortcomings of the available dual band antenna systems, it is desirable to provide a dual band antenna system comprising a low profile, ground independent, omni-directional, dual band antenna which may be mounted to the surface of a dielectric. Accordingly, the present invention is directed to an antenna system that overcomes the aforementioned shortcomings of the prior art and which utilizes novel radiating elements to provide a ground plane independent, dual band antenna suitable for transmission and reception of signals in two separate, selected frequency bands in either of the AMPS/GSM and either of the PCN/PCS frequency bands.

It is therefore a general object of the present invention to provide a new dual band antenna system that is ground plane independent.

It is another object of the present invention to provide an inexpensive dual band antenna system that includes a low-profile, omni-directional antenna.

It is yet another object of the present invention to provide an improved antenna system having a dual band, ground plane independent concealed antenna that is adapted for mounting on a glass surface of a vehicle or building, the antenna assembly having a flexible housing that adapts to its mounting surface.

It is still yet another object of the present invention to provide a dual band antenna system which includes a planar radiating structure formed on a circuit board that utilizes both broadband and microwave technology to transmit and receive RF signals at two separate, selected frequency bands in either of the AMPS/GSM frequency bands and either of the PCS/PCN frequency bands.

It is yet another object of the present invention to provide a flexible outer housing for an antenna assembly having a discontinuous outer configuration that permits the housing to conform to the shape of different dielectric surfaces, to thereby facilitate the installation of the antenna assembly.

It is yet a further object of the present invention to provide a ground-plane independent, dual band antenna system that utilizes a radiating structure having a tuning bridge that capacitively and inductively loads a portion of the radiating structure to thereby permit selection of two different resonant frequency bands for the antenna system.

It is still another object of the present invention to provide a dual band antenna system having a tuning bridge which permits selection of the two resonant frequency bands of the antenna system by setting the electrical length and/or width of the elements of the tuning bridge to specific values.

It is yet another object of the present invention to provide a dual band antenna system comprising a tuning bridge formed with transmission line-like conductive strips.

SUMMARY OF THE INVENTION

In accomplishing these objects and as exemplified in the preferred embodiment of the present invention, an antenna system having a dual band radiating structure is provided in which the radiating structure includes a tuning element in the form of a tuning bridge.

The radiating structure of the antennas of the present invention as exemplified by the preferred embodiment thereof is defined by a conductive layer disposed on a circuit board held within an outer housing. The conductive layer includes two conductive portions that cooperatively define a cone-angle section on the circuit board. The two conductive portions are interconnected by a tuning network in the form of a tuning bridge. The conductive portions and the tuning network are arranged in the preferred embodiment in a mirror image-like manner around a line of symmetry on the circuit board.

In another principal aspect, the radiating structure of the antenna of the present invention does not use a ground plane in association therewith and is therefore ground plane independent, thereby eliminating the need for placing the antenna in a specific location on a vehicle window. The configuration of the radiating structure further renders the antenna omni-directional rather than unidirectional.

In still another principal aspect of the present invention, a flexible housing for an antenna is provided having a discontinuous outer surface that includes a plurality of indentations formed therein which impact a degree of flexibility to the housing, thereby adapting it for mounting on curved glass or other dielectric surfaces and thereby eliminates the need to modify the mounting surface or to use a magnetic mounting assembly.

These and other features, objects and advantages of the present invention will become more apparent from the detailed description set forth below when taken in conjunction with the drawings in which like reference numerals identify like elements throughout.

BRIEF DESCRIPTION OF THE DRAWINGS

In the course of the following detailed description, reference will be made to the attached drawings in which.

DETAILED DESCRIPTION OF THE PREFERRED EMBODIMENTS

Figure 1:
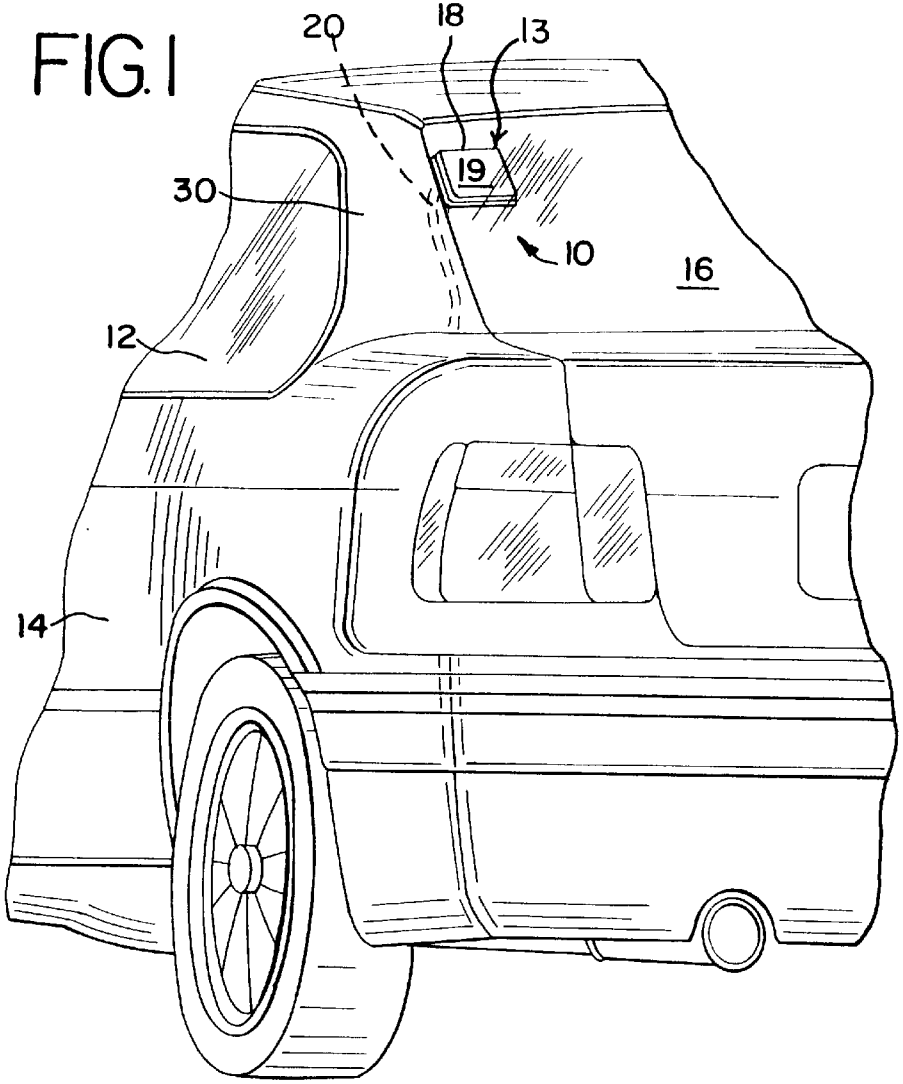
FIG. 1 is a partial perspective view of an antenna system constructed in accordance with the principles of the present invention mounted in plane on an automobile.

Referring now to FIG. 1, a dual band antenna system constructed in accordance with the principles of the present invention is generally designated as 10. The antenna system 10 is a low-profile system that permits wireless transmission and reception of RF signals in two bands of frequency.

The antenna system 10 includes an antenna 11 held within an antenna module 13 that is mounted within the passenger compartment 12 of a vehicle 14. Although the antenna module 13 is illustrated and described hereinafter in the context of being mounted to the interior surface 15 of the vehicle window 16, it will be understood that the antenna module of the present invention finds equal utility when mounted to a building window.

Figure 2:
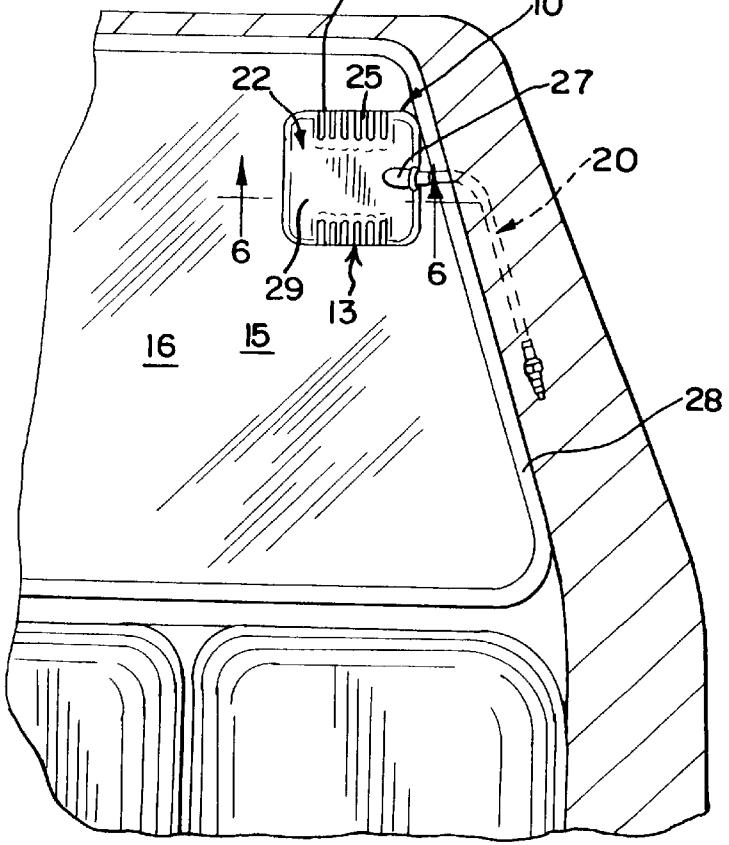
FIG. 2 is an elevational view of the antenna system of FIG. 1 as seen from the interior of the automobile looking rearwardly.

The antenna module 13 includes a housing 22, an interior circuit board 32 with an antenna radiating structure 35 formed thereon, an adhesive attachment member 18 and a feed line 20 which connects the antenna module 13 to a transceiver unit (not shown) in the vehicle 14. The feed line 20 may be run to the transceiver unit within the interior surface 28 with the passenger compartment 12 as illustrated in FIG. 2.

Figure 3:
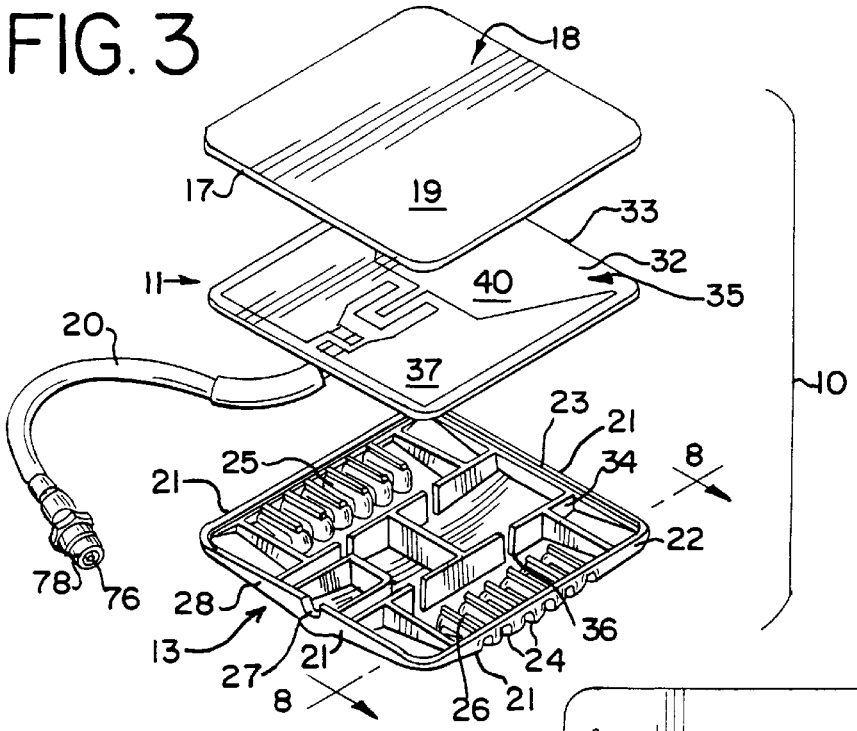
FIG. 3 is an exploded perspective view of the dual band antenna shown in FIG. 1.
Figure 6:
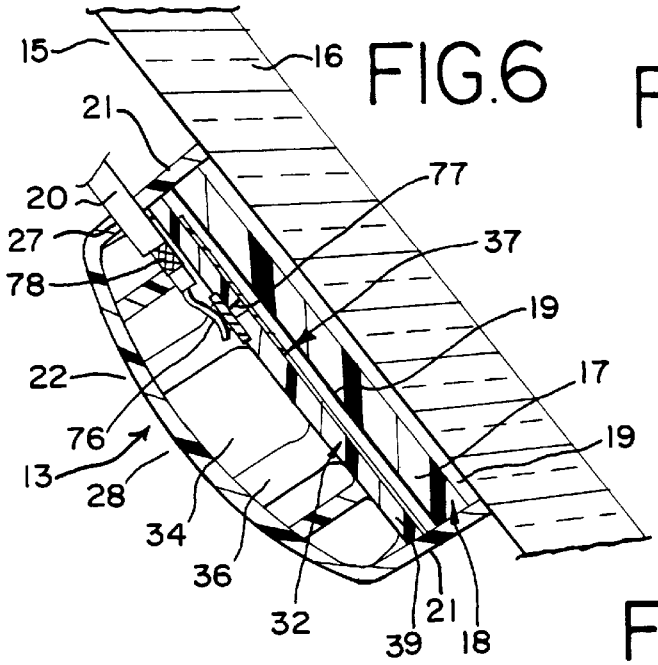
FIG. 6 is a cross-sectional view of the antenna of FIG. 2 taken along lines 6—6 thereof.

Turning now to FIGS. 3 and 6, it can be seen that the antenna housing 22 has a plurality of walls 21 that cooperatively form a hollow interior defined in essence by an interior lip, or shoulder 23, that engages the perimeter 33 of the antenna circuit board 32. A series of additional circuit board supports are provided in the interior of the housing 22 and are illustrated as ribs 34 which extend between opposing edges of the housing 22. Those support ribs 34 preferably abuttingly contact the circuit board 32 and generally reach the level of the housing shoulder 23.

Figure 8:
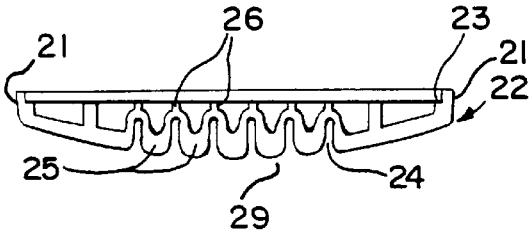
FIG. 8 is a sectional view taken through the antenna housing along lines 8—8 in FIG. 3.

In an important aspect of the present invention, the housing 22 of the antenna module 13 has a structure that permits it to be attached to curved mounting surfaces such as the window 16 shown. In this regard, the housing 22, that is preferably made out of a flexible material, such as a plastic that is sound enough to maintain its structural integrity, yet pliable enough to permit it to bend to match the contour of the window 16. The housing 22 further includes, in its top wall 29, a series of indentations 24 formed therein that are separated by intervening ridges 25 to form, as illustrated in FIG. 8, an accordion-like structure, when viewed in cross-section. In the interior of the housing 22, each of the indentations 24 may be further provided with secondary support ribs 26 that supplement the function of the main support ribs 34. In order to accommodate passage of the antenna feed line 20 out of the housing 22, a port 27 may be provided in one of the housing walls. The combination of indentations 24 and ridges 25 in the housing 22 permit the outer wall 29 thereof to flex to a greater degree than a solid housing wall, and thereby enhances the capability of the housing 22 to match the contour of the window 16.

In order to complement the flexibility aspect that the indentations 24 and ridges 25 provide, it is desirable that the interior support ribs 34 are discontinuous in their extent between the opposing ends of the housing 22. As illustrated best in FIG. 3, the housing support ribs 34 include a plurality of interruptions, shown illustrated as slots 36. These discontinuities permit the support ribs 34 to flex along with the housing 22 and enhance the ability of the housing 22 to attach to various window contours.

As mentioned above, the antenna module 13 is preferably adhesively attached to the window 16 by way of an adhesive member 18 that is interposed between the antenna module 13, particularly the circuit board 32 thereof and the window mounting surface 15. In this regard, the adhesive member 18 has a substrate 17 with adhesive layers or coatings 19 disposed on its opposite sides. (FIG. 6.) The adhesive member 18 preferably extends to the perimeter of the housing 22 (and circuit board 32) to provide a seal between the antenna circuit board 32 and the window 16. The adhesive member 18 material has a thickness which has an effect on the electrical characteristics of antenna system 10 in that it will increase the load of the radiating structure 35. To tune the antenna system 10, the thickness of the adhesive member 18 is maintained at a predetermined value and is then taken into account along with the dimensions of the other elements of the antenna system.

Figure 4A:
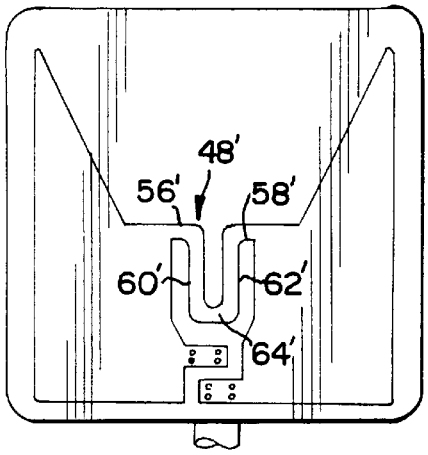
FIG. 4A is a plan view of a circuit board illustrating an alternate radiating structure suitable for use in the antenna of FIG. 1.
Figure 4:
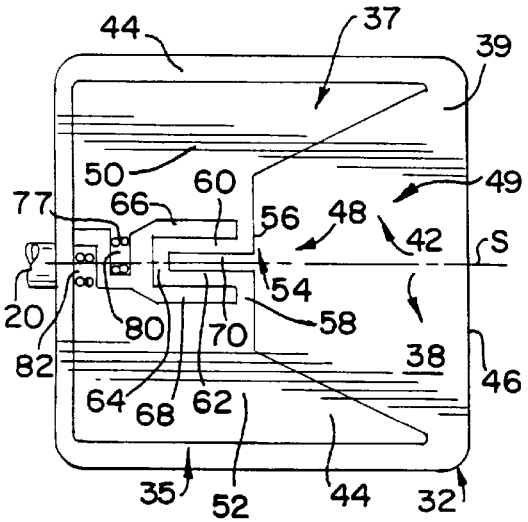
FIG. 4 is a top plan view of the interior circuit board of the dual band antenna of FIG. 3.

Turning now to FIGS. 3 and 4, the details of the antenna radiating structure 35 shall now be described in detail. The circuit board 32 has a conductive layer 37 disposed on the outer surface 38 of the circuit board substrate 39. The conductive layer 37 defines the radiating structure 35 of the antenna 10 on the circuit board 32 and may be formed thereon of conventional means, such as photo-resist etching. The conductive layer 37 is preferably a highly conductive metallic material, such as copper, while the circuit board 32 may be formed from a conventional circuit board material, such as a fiberglass-reinforced epoxy material. The circuit board 32 preferably is of a thickness that imparts a flexible nature thereto so that the circuit board 32 will flex with the antenna module housing 22 when mounted to a curved surface.

The radiating structure 35 of the antenna system 10 of the present invention uniquely takes advantage of broadband and microwave technology to act as a dual band antenna to transmit and receive RF signals at two separate, selected frequency bands separated by about 1000 MHz. The radiating structure 35 of the antenna 11 is further tunable, as explained in greater detail below, to transmit and receive signals in the AMPS frequency band (about 824 MHZ to about 894 MHz) and the PCS frequency band (about 1850 MHz to about 1990 MHz), or in the GSM frequency band (about 890 MHz to about 960 MHz) and the PCN frequency band (about 1710 MHz to about 1880 MHz). The separation between these frequency bands ranges from about 750 MHz to about 1096 MHz and may be considered to average about 1000 MHz.

Figure 9:
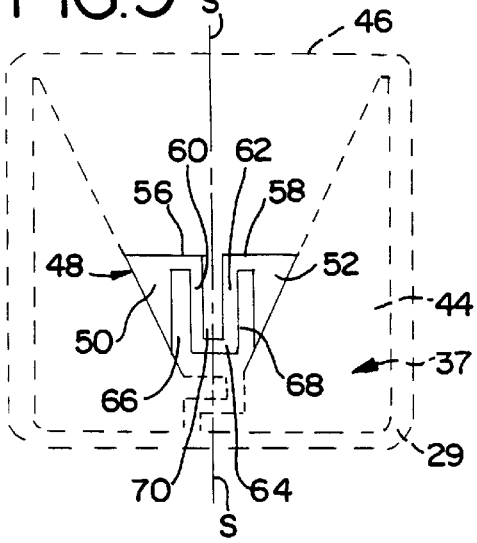
FIG. 9 is an enlarged detail view of the radiating structure of FIG. 4 highlighting the tuning bridge portion thereof.

The radiating structure 35 first takes advantage of broadband technology by way of a special angled section 42 in the form of a cone. This cone-angle section 42 is defined largely by two conductive portions 44 that are mirror images of each other and positioned on opposite sides of a line of symmetry 8 that coincides with a centerline of the circuit board 32 in the preferred embodiment. As illustrated, the two conductive portions 44 are substantially right triangular portions. (FIGS. 4 & 9.) In effect, cone-angle section 42 of radiating structure 35 would operate much like a steel broadband dipole if it constituted the entire radiator of the antenna, and if the tuning network described below was not present to interconnect the conductive portions 44 together.

The antennas of the present invention also take advantage of the principles of microwave technology by interconnecting the conductive portions 44 with a tuning network, illustrated as a tuning bridge 48. As will be appreciated, the tuning bridge 48 permits the radiating structure 35 of the antenna system 10 to resonate within two separate, selectable frequency bands. The tuning bridge 48 is part of the conductive layer 37 of the circuit board 32 and may be formed at the same time the two conductive portions 44 are formed.

The tuning bridge 48 interconnects the two conductive portions 44 as shown in the throat 49 of the cone-angle section 42. In the preferred embodiment, the tuning bridge is substantially symmetrical and is aligned with the line of symmetry 8 of the radiating structure 35. As shown best in FIG. 9, which highlights the tuning bridge 48, it can be seen that the tuning bridge 48 includes first and second triangular portions 50, 52 which are mirror images of each other and are positioned on opposite sides of the line of symmetry 8 of the radiating structure 35 and are positioned along the angled surfaces of the conductive portions 44. The tuning bridge further includes a series of transmission line-like strips 48 that are arranged in a unique pattern to define, as illustrated in FIG. 4, a pulse-like or square wave-like section, generally 54. This pulse-like shaped section 54 preferably includes a pair of first conductive strips 56, 58 that are substantially identical in configuration and are disposed on opposite sides of the line of symmetry S and extend from their respective associated triangular portions 50, 52 toward the line of symmetry S. Preferably, these first conductive strips 56, 58 extend generally perpendicular to the line of symmetry S.

A pair of second conductive strips 60, 62 are also provided as part of the tuning bridge 48. These second conductive strips 60, 62 angularly extend from the first strips 56, 58 in a different direction and preferably perpendicular to the first strips 56, 58. In the embodiment shown, the second strips 60, 62 extend generally parallel to the line of symmetry S on opposite sides thereof.

A third conductive strip 64 is provided that extends between the ends of conductive strips 60, 62 and bridges the free ends thereof. Conductive bridge strip 64 extends in a third direction across the line of symmetry S that is generally parallel to that of the first conductive strips 56, 58. The line of symmetry S acts as a perpendicular bisector of the radiating structure 35. The structure of the tuning bridge 48 defines three dielectric gaps 66, 68, 70. Two such dielectric gaps 66, 68 are disposed between the triangular portions 50, 52 and the first conductive strips 60, 62 of the tuning bridge 48 while the third dielectric gap 70 is positioned between the second conductive strips 60, 62.

Figure 7:
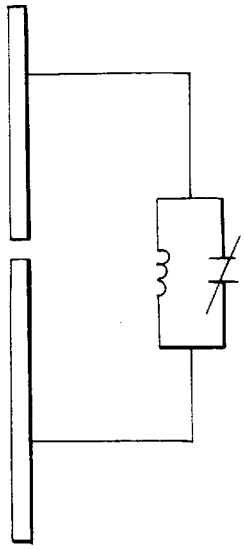
FIG. 7 is a schematic diagram of the antenna of FIG. 3.

It will be appreciated by those skilled in the art that the tuning bridge 48 forms a structure that contributes to the capacitive and inductive loading for the antenna radiating structure 35 as illustrated in FIG. 7. A change in the electrical characteristics of tuning bridge 48 will in a change in the resonant frequencies for radiating structure 35. Thus, by changing the electrical length and/or width of the tuning bridge 48, it is possible to tune the radiating structure 35 so that it resonates within two separate and distinct, selectable frequency bands. For instance, each of the dielectric gaps 66, 68, 70 may be shorted by placing a suitable conductor such as foil or wire across the gaps. By doing so, the electrical length and/or width of the elements of tuning bridge 48 are altered which, in turn, changes the inductive and/or capacitive loading for radiating structure 35. As a result, the two resonant frequency bands for radiating structure 35 may be selected and changed so that the radiating structure comprises a tunable dual band antenna. Although the conductive strips 56, 58, 60, 62 and 64 that make up part of the tuning bridge 48 illustrated in FIG. 4 are shown arranged in a linear fashion, it is contemplated that the conductive strips 56', 58', 60', 62' and 64' may be arranged in a curvilinear fashion to form a serpentine section 48' as illustrated in FIG. 4A. The tuning bridge 48 may also be moved out of the throat 49 toward the far edge 46 of the circuit board 32 to change the tuning features of the antenna 11.

Figure 5:
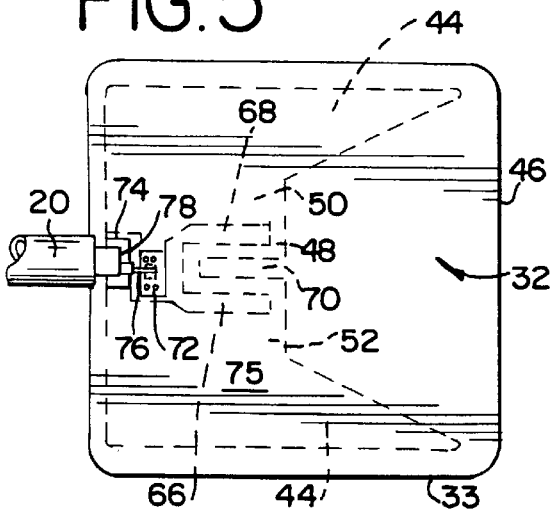
FIG. 5 is a bottom plan view of the circuit board of FIG. 4 illustrating the connection between the system feed line and the antenna radiating structure.

Referring now to FIGS. 5 and 6, the connection between the feed line assembly 20 and the radiating structure 35 for antenna system 10 is shown in greater detail. In particular, two terminals or contact pads 72, 74 are disposed on the bottom surface 75 of the circuit board 32. The inner conductor 76 of the feed line 20 is connected to terminal 72, preferably by soldering. Likewise, the outer conductor 78 of the feed line 20 is connected to terminal 74. In a manner well known in the art, the two terminals 72, 74 are connected to corresponding terminals 80, 82 (FIG. 4) of the radiating structure 35 through the substrate 39 of the circuit board 32 such as by soldering. One or more holes 77 may be drilled through the circuit board 32 to provide a passage for molten solder to flow between the terminals on the opposite surfaces of the circuit board 32.

Those skilled in the art will appreciate that radiating structure 35 is shorted when fed with a direct current or relatively low frequency signal, but it is loaded when fed with relatively high frequencies such as the RF signals contemplated during operation of dual band antenna system 10.

Based on the foregoing description, it will be appreciated that the dual band antenna system 10 of the invention provides a low profile, omni-directional dual band antenna which enables selection of its two resonant frequency bands by changing the electrical length and/or width of the elements of tuning bridge 48. Further, the preferred embodiment described above comprises a ground plane independent antenna system. As such, the operation of dual band antenna systems of the present invention is not dependent upon situating the radiating structure 35 in close proximity with a ground plane. The dual band antenna system 10 may therefore be mounted to the surface of a dielectric in a position far removed from a ground plane such as the window of an ungrounded office building.

Figure 10:
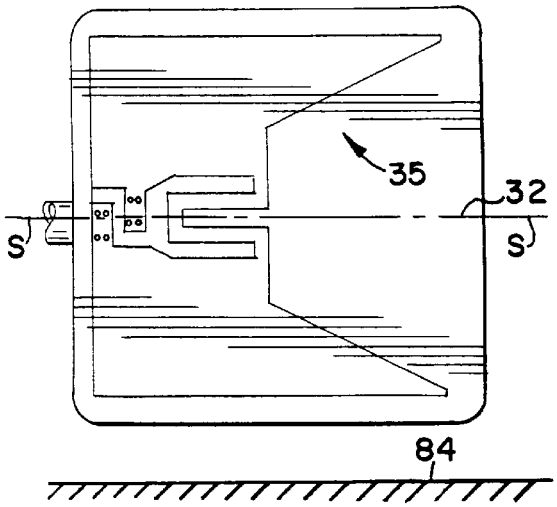
FIG. 10 is a plan view of an alternate embodiment of the present invention, illustrating the radiating structure of FIG. 4 used in association with a ground plane; and, FIG. 11 is a plan view of another embodiment of an antenna constructed in accordance with the principles of the present invention that is ground plane dependent and is equivalent to the antenna system shown and described in FIGS. 1–9.

Although the dual band antennas of the present invention are generally ground plane independent, the use of a ground plane with such antenna systems may provide certain benefits. As shown in the alternate embodiment of FIG. 10, those skilled in the art will recognize that implementation of a ground plane 84 with the radiating structure 35 will provide certain benefits. By extending the ground plane 84 generally perpendicular to the plane of the circuit board 32, but not through the circuit board 32, the radiating structure 35 along with its corresponding image resulting from use of the ground plane, will provide twice as much gain to the antenna as without a ground plane. For vertically polarized radiation, the ground plane should extend in the direction shown in FIG. 10, namely parallel with the line of symmetry 8 for the radiating structure 35 and perpendicular to the plane of the radiating structure. On the other hand, for horizontally polarized radiation, the ground plane 84 should extend in a different direction, namely in a direction transverse to that shown in FIG. 10.

Figure 11:
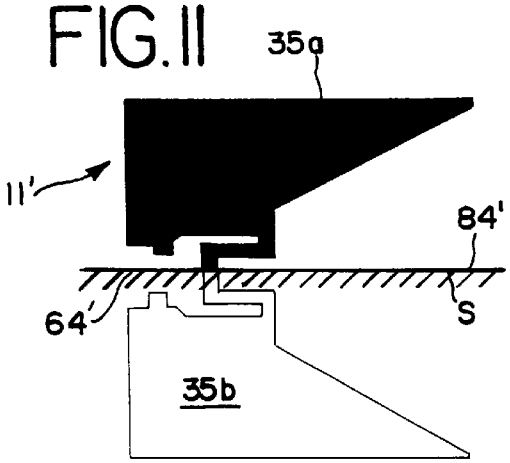

Furthermore, although the preferred embodiment of the above-described dual band antenna system 10 is referred to as a ground plane independent antenna system, another alternate embodiment of an antenna 11' is shown in FIG. 11 that uses a ground plane 84' with only half of the radiating structure 35 which results in an antenna that is equivalent to the antenna system 10 of FIGS. 1–9 is shown. To achieve this result, the ground plane 84 is preferably positioned at the line of symmetry S for the radiating structure 35" of FIG. 4 so that it perpendicularly bisects the plane of circuit board 32 at the line of symmetry S and so that the third strip 64' contacts the ground plane 84'. In effect, only one half of the radiating structure 35*a* is physically present in this antenna system, i.e., that shown in solid in FIG. 11. The other half is provided by the image 35*b* resulting from use of the ground plane. Accordingly, the equivalent of the entire above-described radiating structure of the preferred embodiment (FIGS. 1–9) would exist. As such, those skilled in the art will appreciate that, although it is not identical to the preferred embodiment shown and described above, this ground plane dependent embodiment falls within the literal scope of the appended claims.

The antenna system 10 illustrated in the preferred embodiment is arranged to transmit and receive vertically polarized RF signals such as those typically used for wireless communication systems. Those skilled in the art will appreciate that the antenna system 10 may likewise be arranged to permit transmission and reception of horizontally polarized RF signals.

Accordingly, while the preferred embodiment of the invention has been shown and described in detail, it will be apparent to those skilled in the art that changes and modifications may be made therein without departing from the spirit of the invention, the scope of which is defined by the appended claims.

We claim:

1. A dual band antenna apparatus for mounting on a mounting surface and adapted for transmission and reception of preselected signals in two separate and distinct frequency bands in conjunction with a utilization device, the apparatus comprising: a circuit board having first and second opposing surfaces, a dual band antenna radiating structure and a tuning network disposed only on the first surface thereof, the radiating structure including first and second conductive portions spaced apart from each other on said first surface, the tuning network being disposed between the first and second conductive portions on said first surface and interconnecting said first and second conductive portions; a housing member for holding said circuit board and for mounting said apparatus to a mounting surface; and a feedline having first and second conductors, the first and second conductors being respectively connected to said first and second conductive portions.

2. A dual band antenna apparatus as defined in claim 1, wherein said first and second conductive portions include triangular-shaped portions disposed on said circuit board first surface.

3. A dual band antenna apparatus as defined in claim 1, wherein said first and second conductive portions are substantially identical to each other and are symmetrically arranged on opposite sides of an imaginary line extending across said circuit board.

4. A dual band antenna apparatus as defined in claim 2, wherein said two conductive portions define a cone-angle section on said circuit board first surface.

5. A dual band antenna apparatus as defined in claim 4, wherein said cone-angle section includes a throat portion and said tuning network is disposed on said circuit board first surface at said throat portion.

6. A dual band antenna apparatus as defined in claim 1, wherein said tuning network includes a plurality of additional conductive portions arranged symmetrically on opposite sides of an imaginary line extending across said circuit board between said first and second conductive portions.

7. A dual band antenna apparatus as defined in claim 6, wherein said tuning network includes a plurality of dielectric gaps disposed between said additional conductive portions, said tuning network being shortable across said dielectric gaps to set said two distinct frequencies of said antenna.

8. A dual band antenna apparatus as defined in claim 7, wherein said two frequencies are separated by between about 750 megahertz to about 1096 megahertz.

9. A dual band antenna apparatus as defined in claim 1, wherein one of said frequencies is in the AMPS frequency band and the other of said two frequencies is in the PCS frequency band.

10. A dual band antenna apparatus as defined in claim 1, wherein one of said two frequencies is in the GSM frequency band and the other of said two frequencies is in the PCN band.

11. A dual band antenna apparatus as defined in claim 1, wherein said tuning network includes a plurality of additional conductive portions including first, second and third conductive strips arranged in a pulse-like pattern.

12. A dual band antenna apparatus as defined in claim 11, wherein said additional conductive portions include a pair of first conductive strips, a pair of second conductive strips and a third conductive strip arranged symmetrically on opposite sides of an imaginary line extending across said circuit board.

13. A dual band antenna apparatus as defined in claim 12, wherein said first conductive strips extend in a first direction, said second conductive strips extend in a second direction that is angularly offset from said first direction and said third conductive strip extends in a third direction that is angularly offset from said second direction.

14. A dual band antenna apparatus as defined in claim 13, wherein said first and third directions are generally parallel to each other and wherein said third conductive strip crosses said imaginary line and interconnects said second conductive strips together.

15. A dual band antenna apparatus as defined in claim 9, wherein one of said housing walls lies opposite said circuit board and includes a plurality of surface interruptions formed therein.

16. A dual band antenna apparatus as defined in claim 15, wherein said surface interruptions include a plurality of indentations formed in said housing one wall, the indentation being separated by intervening ridge portions.

17. A dual band antenna apparatus as defined in claim 15, wherein said housing includes a plurality of circuit board support ribs extending between opposing housing walls in a discontinuous fashion for supporting said circuit board.

18. A dual band antenna apparatus as defined in claim 17, wherein said indentations extend from said housing one wall into said housing interior portion and include a plurality of secondary support ribs disposed thereon that oppose said circuit board.

19. A dual band antenna apparatus as defined in claim 1, wherein said housing has an outer wall with an interrupted outer surface that increases said housing's ability to conform to the contour of said mounting surface.

20. A dual band antenna apparatus as define in claim 18, wherein said housing includes an interior shoulder that engages a perimeter of said circuit board and said support ribs extend at the same level within said housing as said shoulder.

21. A dual band antenna apparatus as defined in claim 1, wherein said tuning network includes a plurality of additional conductive portions extending on said circuit board first surface and between said two conductive portions in a serpentine pattern such that some of said additional conductive portions are separated by dielectric gaps.

22. In a glass-mountable antenna assembly that includes a dual band antenna radiating element and a housing that supports the radiating element, the improvement comprising:

the dual band antenna radiating element including a planar radiating structure disposed on a circuit board supported by said housing, the planar radiating structure including three conductive portions disposed only on a single surface of said circuit board, two of said conductive portions being disposed on opposite sides of an imaginary line extending across said circuit board surface and each of said two conductive portions defining separate radiating antenna elements, said remaining conductive portion extending across said imaginary line and interconnecting said two conductive portions and further defining an impedance matching element of said antenna assembly, said three conductive portions cooperatively defining an antenna capable of transmitting and receiving signals in two distinct, separate frequency bands, the two frequency bands being separated by a frequency band of between about 750 megahertz to about 1096 megahertz.

23. The glass mountable antenna assembly of claim 22, wherein said three conductive portions are arranged in a symmetrical fashion on said circuit board surface such that said imaginary line constitutes a line of symmetry for said antenna radiating element.

24. The glass mountable antenna assembly of claim 22, wherein said three conductive portions are arranged on said circuit board surface in a serpentine pattern.

25. The glass mountable antenna assembly of claim 22, wherein said two conductive portions include generally triangular-shaped portions that cooperatively define a cone-shaped dielectric space on said circuit board surface.

26. The glass mountable antenna assembly of claim 22, wherein said three conductive portions are arranged on said circuit board surface in a pulse-like pattern.

27. The glass mountable antenna assembly of claim 22, wherein said three conductive portions include linear transmission line-like strips that are angularly offset with respect to each other.

28. The glass mountable antenna assembly of claim 22, wherein said circuit board includes a pair of conductive terminals disposed on a second circuit board surface opposite said first surface, the terminals being adapted to engage two different conductors of a dual conductor feedline interconnecting said antenna with a communications transceiver, said pair of terminals extending through said circuit board and being connected to said planar radiating structure.

29. The glass mountable antenna assembly of claim 22, wherein said two district frequency bands are separated by at least about 800 MHz.

30. A ground plane independent, dual band antenna for operation in two different frequency ranges separated by at least about 800 MHZ, comprising: a dielectric substrate having first and second opposing surfaces; first and second conductive planar portions disposed only on said substrate first surface, each of said portions forming a radiating structure of said antenna that resonates in respective first and second preselected frequencies; a tuning network also only disposed on said substrate first surface and interconnecting said first and second conductive portions, the tuning network including a plurality of conductive strips disposed on said substrate first surface, the tuning network including a plurality of dielectric gaps separating said conductive strips from each other, said substrate second surface not having any ground plane conductive portions thereon.

31. The antenna as defined in claim 30, wherein one of said two antenna frequencies falls within the AMPS frequency band and the other of said two antenna frequencies falls within the PCS frequency band.

32. The antenna as defined in claim 30, wherein one of said two antenna frequencies falls within the GSM frequency band and the other of said two antenna frequencies falls within the PCN frequency band.

33. The antenna as defined in claim 30, wherein said tuning network conductive strips are arranged in a symmetrical, pulse-like pattern.

34. The antenna as defined in claim 30, wherein said tuning network conductive strips are arranged in a serpentine pattern.

35. The antenna as defined in claim 30, further including an adhesive member disposed on said substrate first surface for attaching said antenna to a mounting surface, the adhesive member having a predetermined thickness in order to increase loading of said radiating structure.

36. A mounting member for mounting a concealed antenna to a mounting surface, comprising an antenna housing having a plurality of walls cooperatively defining a hollow interior portion, the housing opening communicating with said interior portion and adapted to receive an antenna circuit board therein, one of said housing walls being a major housing wall that is disposed opposite said housing opening, the major housing wall having an outer surface that defines an exterior surface of said housing, said major housing wall outer surface having a series of interruptions formed therein, said interruptions permitting said housing to flex in order to match the configuration of said mounting surface.

37. The antenna mounting member of claim 36, wherein said housing interior portion includes a shoulder member that engages at least a portion of a perimeter of said antenna circuit board.

38. The antenna mounting member of claim 36, wherein said major housing wall outer surface interruptions include a plurality of indentation extending into said housing interior portion.

39. The antenna mounting member of claim 38, wherein said housing indentations are arranged along at least one side edge of said major housing wall outer surface.

40. The antenna mounting member of claim 38, further including a plurality of ridges disposed between adjacent housing indentations.

41. The antenna mounting member of claim 36, further including at least one discontinuous primary support member disposed in said housing interior portion and extending toward said housing opening to engage said antenna circuit board.

42. The antenna mounting member of claim 38, wherein said primary support member includes at least one slot formed therein.

* * * * *